US005171908A

United States Patent [19]

Rudnick

[11] Patent Number: 5,171,908

[45] Date of Patent: Dec. 15, 1992

[54] SYNTHETIC POLYOLEFIN LUBRICANT OIL

[75] Inventor: Leslie R. Rudnick, Lawrenceville, N.J.

[73] Assignee: Mobil Oil Corporation, Fairfax, Va.

[21] Appl. No.: 794,095

[22] Filed: Nov. 18, 1991

[51] Int. Cl.[5] ..... C07C 2/00; C07C 2/04

[52] U.S. Cl. ..... 585/255; 585/10; 585/12; 585/300; 585/510

[58] Field of Search ..... 585/10, 12, 250, 255, 585/502, 510, 300

[56] References Cited

U.S. PATENT DOCUMENTS

| | | | |
|---|---|---|---|
| 2,000,964 | 5/1935 | Lenher | 260/170 |
| 2,111,831 | 3/1930 | Batchelder | 196/10 |
| 2,500,166 | 3/1950 | Seger et al. | 260/683.1 |
| 2,706,211 | 4/1955 | Clark | 585/255 |
| 3,883,417 | 5/1975 | Woo et al. | 208/49 |
| 4,124,650 | 11/1978 | Olavesen et al. | 585/255 |

OTHER PUBLICATIONS

F. M. Seger et al, "Noncatalytic Polymerization of Olefins to Lubricating Oils", *Industrial and Engineering Chemistry* 2446 to 2452 (1950).

*Primary Examiner*—Anthony McFarlane
*Attorney, Agent, or Firm*—Alexander J. McKillop; Charles J. Speciale; Jessica M. Sinnott

[57] ABSTRACT

The invention is directed to method of making a thermally and oxidatively stable lubricating oil having a high viscosity index and a low pour point by the thermal polymerization of 1-olefins containing 8 to 10 carbon atoms, the preferred 1-olefins are 1-decanes. The polymerization is conducted at temperatures ranging from 280° C. to 350° C. and low pressures, of less than about 280 psig, in a reactor which is free of catalytic material. Thereafter, the polyalphaolefin is hydrotreated over a nickel catalyst, preferably nickel on Kieselguhr. In an improved process the polyalphaolefin is separated from a low molecular weight product by distillation. The low molecular product contains unreacted 1-olefins which are recycled to the thermal polymerization zone to produce more of the lubricant base stock. The remaining lower molecular weight olefinic materials which include mixed olefins, paraffins, cracked olefins and olefin dimers are routed to a polymerization zone to make a second lubricant base stock.

12 Claims, 1 Drawing Sheet

SYNTHETIC POLYOLEFIN LUBRICANT OIL

FIELD OF THE INVENTION

The invention is directed to a method of making a lubricating oil by thermal polymerization of olefins. The invention is also directed to an improved process for making a high performance polyolefin lubricating oil from linear olefins.

BACKGROUND OF THE INVENTION

Engines which are required to operate under severe conditions of high temperatures for extended periods of time need a high performance lubricant that can withstand the extreme conditions. High performance lubricants will not degrade under high temperatures and will have a relatively small change in viscosity over a wide temperature range; that is, a high viscosity index.

Attempts to thermally polymerize various 1-olefins have been described. For example, U.S. Pat. No. 2,500,166 teaches a synthetic lubricating oil made from mixtures of normally liquid straight-chain 1-olefins containing from six to twelve carbon atoms by thermal treatment of the olefins. The thermal treatment includes polymerization of 1-decene at 190°–440° C. for 1 to 40 hours and non-critical pressures of reaction ranging from less than 50 to over 1000 pounds per square inch of pressure. The patent identifies as conditions, for good yields of good products, polymerization at a range from 3 to 20 hours and at temperatures of from about 650° F. (330° C.) to about 600° F. (300° C.). The patent teaches that increased pressure is desirable to maximize the yield. Although a high yield is beneficial to refinery operation, the detriment of running a reactor at high pressures can outweigh the benefit of a greater yield.

A 2-stage thermal polymerization of mixed mono-olefins is taught in U.S. Pat. No. 3,883,417. The product is first polymerized under pressure conditions ranging from atmospheric to 1000 psig at temperatures ranging from 300° F. to 650° F. The product is distilled to 600°–650° F. to obtain a purified product which is treated in a second-stage polymerization at 600°–800° F. and at 0 to 1000 psig. The unreacted olefins of the second stage polymerization can be distilled off and recycled to the second-stage polymerization. Although the products resulting from the 2-stage thermal process have a good VI, a higher VI product made by a one-stage thermal process would be desirable.

In general, premium lubricating oils are finished by hydrogen finishing (hydrofinishing) units which eliminate the polar sites in the oil molecules and improve their thermal stability and oxidation stability and lighten their color.

In the hydrofinishing unit the charge oil is first heated, mixed with hydrogen, and then heated again to a temperature sufficient to effectuate reaction. The heated charge is pumped into the reactor which contains a hydrotreating catalyst. The reaction destroys the molecular polarity and lightens the color of the oil.

SUMMARY OF THE INVENTION

The invention is directed to a process for making a finished synthetic lubricating oil base stock by thermal polymerization of linear long chain olefins in a one stage low pressure thermal polymerization, i.e., pressures ranging from 100–280 psig and temperatures ranging from 280°–400° C. for 1 to 24 hours, recovering the high quality polyalphaolefin product by distilling to separate the high quality higher molecular weight polyalphaolefin from a lower molecular weight olefin product which includes a 1-olefin recycle component. The high quality higher molecular weight polyalphaolefin is subjected to hydrotreating to produce a thermally and oxidatively stable finished lubricating oil base stock having a high viscosity index and a low pour point.

The 1-olefin recycle component of the low pressure thermal polymerization is separated from the lower molecular weight olefin product and recycled back to the low pressure thermal polymerization to produce more of the high quality higher molecular weight product. The remaining lower molecular weight olefin product which contains a plurality of cracked olefins including from 3 to 5 carbon atoms and 1-decene dimers is polymerized in a polymerization reaction under conditions of temperature ranging from 200° C. to 400° C. and pressure ranging from 100 to 1000 psig.

DETAILED DESCRIPTION OF THE INVENTION

Figure 1:
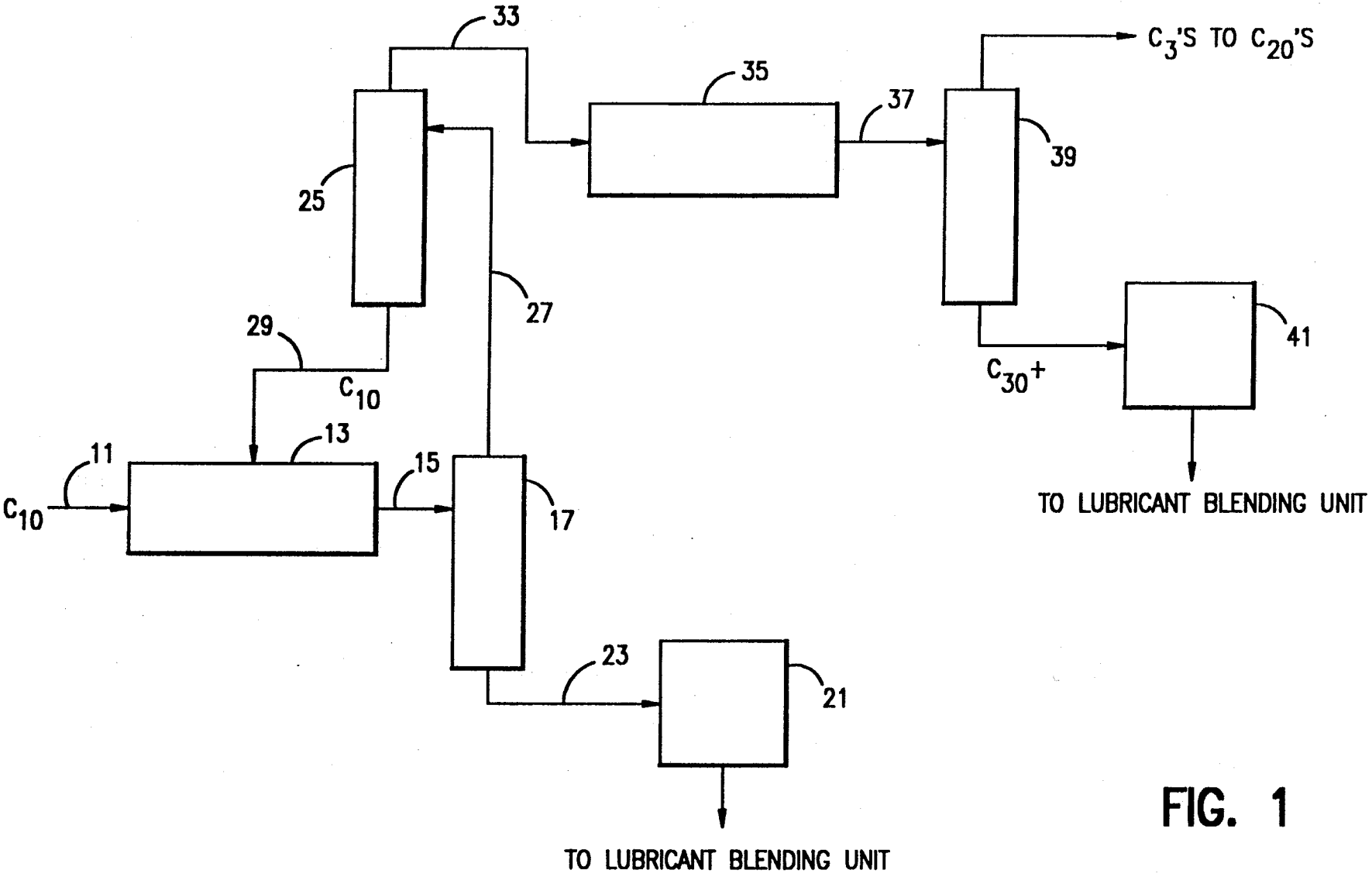
FIG. 1 is a simplified schematic diagram of a process for making the finished lubricating oil of the instant invention.

A thermally and oxidatively stable synthetic polyalphaolefin lubricating oil has now been made in a 1-stage low pressure thermal polymerization process to produce a high quality, high viscosity index and low pour point product in commercially viable yields.

An object of the invention is to increase the thermal and oxidative stability of a polyalphaolefinic lubricating oil base stock.

A further object of the invention is to produce a high viscosity index, low pour point polyalphaolefin lubricating oil base stock without the processing costs associated with the catalytic manufacture of polyalphaolefinic base stocks.

It is a feature of the invention to thermally polymerize relatively pure linear long chain olefins in a reactor which is substantially free of catalytic material under conditions which permit the polymerization of the olefins.

It is an advantage of the invention that producing a finished lubricating oil base stock by hydrotreating thermally polymerized polyalphaolefins results in a water white product which has a high viscosity index and a low pour point.

It is a further advantage of the invention to produce a very pure polyalphaolefin in a thermal polymerization process by utilizing an olefin recycle step.

The properties of the synthetic lubricating oils of the invention present an improvement over the properties of the known polyalphaolefin lubricating oils in that the product can withstand more severe thermal conditions. Additionally, the thermal polymerization product of the invention has a lesser tendency to form deposits when exposed to the severe operating conditions found in a diesel engine.

The starting materials are substantially pure linear long chain mono-olefins ranging from 8 to 10 carbon atoms, such as 1-octene, 1-nonene and 1-decene. The preferred olefin is 1-decene. Although charged stocks of mixed olefins produce a suitable product, it was a discovery of the invention that polymerization of 1-decene produced a product with superior performance properties.

The process conditions are critical to the invention. The optimum polymerization conditions described herein have been found to produce a superior synthetic lubricating oil. It has been found that the pressure of reaction should not exceed 280 psig in order to produce a product having the necessary high viscosity index, low pour point and resistance to high temperatures. The temperature of reaction should be maintained in a range of 280° to 400° C., preferably from 300° to 350° C. The polymerization reaction should be carried out for 1 to 24 hours, preferably 3 to 20 hours.

The pressure of reaction should be maintained between about 100 psig and 280 psig. Preferably the pressure is maintained below 250 psig, and most preferably from about 110 to 240 psig.

The finished lubricating oil is made by recovering the polyalphaolefin by distillation which removes the unreacted 1-olefins, cracked hydrocarbons and olefin dimers. Distillation is accomplished under a vacuum to remove the 1-olefins and olefin dimers. For example, 1-decene, having a boiling point above 170° C. and the 20 carbon 1-decene dimers having a boiling point above 340° C. are separated by making a final cut at 170° C./1.0 mm Hg. The separation can be accomplished by collecting the 1-olefin fraction individually; that is, separate from the dimer, or one cut can be made which contains both the 1-decene and the 1-decene dimer. The remaining product is the desired high quality polyalphaolefin.

Thereafter the product is recovered and hydrotreated under very specific conditions which are necessary to maintain the high viscosity index and low pour point of the polymerization product. The hydrotreating is conducted to saturate the double bonds of the polymerization product and produce a commercially desirable water white synthetic lubricant. The preferred hydrotreating catalyst is a nickel on diatomaceous earth, or kieselguhr, catalyst such as 649D manufactured by United Catalysts, Inc. The conditions of hydrotreating include temperatures ranging from about 50° C. to 300° C., preferably 100° C. to 200° C. Relatively high pressures are employed, i.e. ranging from 300 to 600 psig of hydrogen. Most preferably, the conditions include temperatures of 150° C. and pressures of 600 psig of hydrogen.

FIG. 1 presents a simplified schematic diagram of an improved process for making a finished polyalphaolefin lubricant base stock in accordance with the instant invention. A plurality of linear olefins containing 8 to 10 carbon atoms, preferably pure 1-decenes, are fed to a first polymerization reactor 13 via line 11. The reactor is free of any catalytic material and is operated at temperatures ranging from 280° C. to 400° C., preferably from 300° to 350° C., and pressures of less than about 280 psig. The polymerization is carried out for 1 to 20 hours. The reaction product is conveyed through line 15 to a distillation zone 17 which separates the polyalphaolefins from the low molecular weight olefins. The polyalphaolefins have a viscosity index (IV) of 140–160. The polyalphaolefins include long chain hydrocarbons containing more than 24 carbon atoms from polymerization of the $C_8$ olefins preferably more than 27 carbon atoms from the polymerization of the $C_9$ olefins and most preferably, more than 30 carbon atoms from the polymerization of the $C_{10}$ olefins. The low molecular weight olefins include unreacted olefins, cracked olefins and olefinic products of dimerization which contain at least 16 carbon atoms to at most 20 carbon atoms.

Alternatively, the reaction can be carried out in a batch operation in which the reactor is set at the proper reaction temperature, loaded with the 1-olefin feed, sealed and subjected to an inert gas, i.e. nitrogen, flush. The reactor is heated to 280°–400° C. for 1–20 hours. The product is then transferred to a distillation unit. Alternatively, the product is distilled directly from the reactor.

In the preferred method, the olefins are reacted at the elevated temperatures and under autogenous or externally imposed gaseous pressures maintained below 280 psig. Non-limiting examples of non-reactive gases include nitrogen, helium and argon.

The polyalphaolefins are routed to hydrotreating unit 21 via line 23 wherein the polyalphaolefins are purified to produce a lubricant base stock. The hydrotreating conditions are critical to avoid significantly reducing the viscosity index or raising the pour point properties of the base stock. The preferred hydrotreating unit is operated under mild conditions and employs a nickel on diatomaceous earth catalyst. The operating conditions of the hydrotreating unit include a reactor temperature of 150° to 300° C. and pressures ranging from 300 to 600 psig. The finished lubricant base stock is then conveyed to a lubricant blending plant for blending with suitable additive packages to make the commercial lubricant product.

The low molecular weight olefins are conveyed to separator 25 through line 27. The unreacted olefins, i.e., 1-decenes, are separated and recycled to the first polymerization zone 13 via line 29.

The instant invention is considered a one stage thermal polymerization reaction because a satisfactory final product is obtained after one thermal polymerization reaction. This is opposed to a two-stage thermal polymerization reaction which would require that the entire product of the first polymerization be again subjected to a polymerization reaction to obtain a suitable product. A second polymerization reaction is applied in the instant invention to only a portion of the product of the first polymerization reaction in order to obtain a second product.

Thus, the remaining low molecular weight components, the cracked olefins and olefinic dimers, are conveyed via line 33 to a second polymerization zone 35 which is operated under conditions which can differ from the first polymerization zone because the olefinic feed covers a much broader molecular weight range. The operating conditions of the second polymerization zone 35 can be more severe to compensate for the higher molecular weight dimers which would be more difficult to polymerize. The temperatures of the reaction zone can range from 200° to 400° C., preferably 300° C. to 350° C. and pressures can range from about 100 to 1000 psig. Since the purity of the feed to this second polymerization zone is not as important as that of the first polymerization zone, the feed can also include other feeds, a representative example is a cracked wax containing mixtures of $C_8$ and $C_{10}$ olefins as well as charge stocks containing hydrocarbons of broader molecular weight ranges such as olefinic hydrocarbons containing 5 to 20 carbon atoms. The second polymerization reaction is conducted in the presence or absence of a conventional polymerization catalyst. Preferred polymerization catalysts include HCl, $H_2SO_4$ and Lewis acid catalysts such as $BF_3$ and $AlCl_3$. The resulting polyalphaolefin is then conveyed via line 37 to distillation zone 39 to remove the low molecular weight olefins which include unreacted olefinic starting materials, cracked olefins $C_3$'s to $C_5$'s and olefinic dimers. Thereafter, the polyalphaolefin is hydrotreated in hydrotreating unit 41 and transported to the lubricant blending plant for blending with suitable additive packages to make the commercial lubricant product.

The thermal polymerization coupled with the olefin overhead recycle process is an advantage over the known polyalphaolefin processing techniques. The thermal polymerization facilitates the olefin recycle because there is no need for spent catalyst removal which is costly and time consuming. Additionally, there is no need for catalyst regeneration which is also costly and amounts to a separate process. The invention produces a very high quality product since the undesirable low molecular weight components are constantly removed with recycle. Additionally, greater quantities of the high quality thermally stable product are made without the addition of extra 1-olefin feed because of the 1-olefin recycle.

The following examples present a more detailed description of the thermal polymerization process of the instant invention.

EXAMPLE 1

A reactor under a nitrogen atmosphere was loaded with 1500 grams of 1-decene and stirred while being heated to 310° C. Pressure was autogenous and maintained at or below 135 psig. The temperature was maintained for 16 hours, after which time the heating was stopped. The reaction mixture was distilled to remove any unreacted decene and volatile products. The conversion was 33.5%.

EXAMPLE 2

A reactor under a nitrogen atmosphere was loaded with 1500 grams of 1-decene and stirred while being heated to 330° C. pressure was autogenous and maintained at or below 250 psig. The temperature was maintained for 16 hours, after which time the heating was stopped. The reaction mixture was distilled to remove any unreacted decene and volatile products. The conversion was 58.1%.

EXAMPLE 3

A reactor under a nitrogen atmosphere was loaded with 1500 grams of 1-decene and stirred while being heated to 350° C. Pressure was autogenous and maintained at or below 250 psig. The temperature was maintained for 16 hours, after which time the heating was stopped. The reaction mixture was distilled to remove any unreacted decene and volatile products. The conversion was 74%.

EXAMPLE 4

A reactor under a nitrogen atmosphere was loaded with 1500 grams of 1-decene and stirred while being heated to 350° C. Pressure was maintained at 230 psig. The temperature was maintained for four hours, after which time the heating was stopped. The reaction mixture was distilled to remove any unreacted decene and volatile products. The conversion was 40.2%.

EXAMPLE 5

A reactor under a nitrogen atmosphere was loaded with 1500 grams of 1-decene and stirred while being heated to 310° C. Pressure was maintained at 135 psig. The temperature was maintained for 16 hours, after which time the heating was stopped. The reaction mixture was distilled to remove any unreacted decene and other volatiles. The product polyolefin was removed and hydrogenated using nickel on kieselguhr at 150° C./600 psig $H_2$ to provide a clear product. The conversion was 30%.

EXAMPLE 6

A reactor under a nitrogen atmosphere was loaded with 1500 grams of 1-decene and stirred while being heated to 330° C. Pressure was maintained at 250 psig. The temperature was maintained for 16 hours, after which time the heating was stopped. The reaction mixture was distilled to remove any unreacted decene and other volatiles. The product polyolefin was removed and hydrogenated using nickel on kieselguhr at 150° C./600 psig $H_2$ to provide a clear product. The conversion was 58%.

EXAMPLE 7

A reactor under a nitrogen atmosphere was loaded with 1500 grams of 1-decene and stirred while being heated to 350° C. Pressure was maintained at 250 psig. The temperature was maintained for 16 hours, after which time the heating was stopped. The reaction mixture was distilled to remove any unreacted decene and other volatile components such as 5 carbon olefins and 1-decene dimers. The product polyolefin was removed and hydrogenated using nickel on Kieselguhr at 150° C./600 psig $H_2$ to provide a clear product. The conversion was 74%.

EXAMPLE 8

A reactor under a nitrogen atmosphere was loaded with 1500 grams of 1-decene and stirred while being heated to 350° C. Pressure was maintained at 230 psig. The temperature was maintained for 4 hours, after which time the heating was stopped. The reaction mixture was distilled to remove any unreacted decene and other volatiles. The product polyolefin was removed and hydrogenated using nickel on kieselguhr at 150° C./600 psig $H_2$ to provide a clear product. The conversion was 40%.

EVALUATION OF THE PRODUCTS

The kinematic viscosity, of the products of the examples both before and after hydrogenation, at 40° C. and 100° C. was evaluated as well as the viscosity index and pour point. The data collected before hydrogenation are presented in Table 1. The data collected after hydrogenation are presented in Table 2.

TABLE 1

| | | THERMAL POLYMERIZATION PRODUCT | | | | | |
|---|---|---|---|---|---|---|---|
| Ex. | Olefin | Temp. (°C.) | Pressure (psig) | KV @ 40° C. | KV @ 100° C. | VI | Pour Point °F. |
| 1 | $C_{10}$ | 310° C. | at or less than 135 | 46.0 | 8.22 | 154 | −65 |
| 2 | $C_{10}$ | 330° C. | at or less | 33.9 | 6.53 | 150 | −65 |

TABLE 1-continued

| THERMAL POLYMERIZATION PRODUCT | | | | | | | |
|---|---|---|---|---|---|---|---|
| Ex. | Olefin | Temp. (°C.) | Pressure (psig) | KV @ 40° C. | KV @ 100° C. | VI | Pour Point °F. |
| 3 | $C_{10}$ | 350 | than 250 at or less | 32.3 | 6.14 | 146 | −30 |
| 4 | $C_{10}$ | 350 | than 250 at or less than 230 | 26.6 | 5.57 | 155 | −31 |

The data of Table 1 show that the VI, viscosity, and pour point of the thermal polymerization products of pure 1-decene made in accordance with the invention are very good.

TABLE 2

HYDROGENATED THERMAL POLYMERIZATION PRODUCT HYDROGENATION CARRIED OUT AT 150° C., 600 psig $H_2$ OVER Ni CATALYST

| Example | Olefin | KV @ 40° C. | KV @ 100° C. | VI | Pour Point °F. |
|---|---|---|---|---|---|
| 5 | $C_{10}$ | 50.8 | 8.59 | 146.4 | −25 |
| 6 | $C_{10}$ | 40.8 | 7.38 | 147.7 | −20 |
| 7 | $C_{10}$ | 34.4 | 6.54 | 147.2 | −0 |

The data of Table 2 show that hydrogenating the thermal polymerization product of 1-decene over a nickel on kielselguhr catalyst at 150° C. and 600 psig $H_2$ in accordance with the invention significantly improves the kinematic viscosity (KV) at 40° C. and 100° C. Hydrogenating the products does not significantly lower the viscosity index of the product.

The products were tested for their thermal stability at elevated temperatures. The change in viscosity over time for the hydrogenated thermal polymerization product of Example 1 and a catalytically synthesized 1-decene polymer was evaluated and the data collected are presented in Table 3. The test procedure included placing a 1-inch test tube containing a sample of the test lubricant in an aluminum block. A nitrogen blanket was maintained over the sample to prevent oxidation. After 72 hours of exposure to 310° C. the change in lubricant viscosity was measured using the formula $$\frac{V_i - V_f}{V_i} = V \times 100\% = \text{viscosity change}$$

where $V_i$=initial lubricant viscosity and $V_f$=final lubricant viscosity. The % viscosity change is reported as a negative number when the final viscosity is lower than the initial viscosity.

TABLE 3

THERMAL STABILITY TEST RESULTS

| | % Viscosity Change After 72 Hours |
|---|---|
| Hydrogenated Thermal Oligomer (of Example 1) | −4.4 (at 310° C.) |
| Commercial catalytically synthesized 1-decene polyolefin: Sample 1 | −23 (at 310° C.) |

Table 4 presents a comparison between the oxidative stability of the hydrogenated product of example 1 with the same catalytically synthesized 1-decene polymer as shown in Table 3. The oxidative stability was measured in the hot tube test.

The hot tube oxidation test measures the tendency of a sample to form deposits. These tests were run on a formulated diesel engine oil, the only difference being a change of base stock. The rating is from 0 to 9, a clean tube achieves a rating of 0, a heavy black carbonaceous deposit on the tube achieves a rating of 9.

The results show that the thermal oligomer is significantly less prone to form deposits than the commercial catalytically synthesized polyalphaolefin sample.

TABLE 4

OXIDATIVE STABILITY TEST RESULTS

| | Hot Tube Oxidation Test |
|---|---|
| Thermal Oligomer of Example 1 | 6 |
| Commercial Synthetic PAO Made Using Catalysis | 9 |

What is claimed is:

1. A process for making a thermally stable lubricating oil comprising:

a. charging a plurality of olefins containing 8 to 10 carbon atoms to a primary polymerization zone under polymerization conditions sufficient to produce an olefinic product having a viscosity index ranging from about 140 to 160 and a pour point ranging from about −65° to −30° F., the conditions comprising temperatures ranging from 280° C. to 400° C. and pressures less than about 280 psig sustained for 1 to 24 hours in a reactor which is free of catalytic material, the olefinic product includes a first polyalphaolefin component containing polyalphaolefins of at least 24 carbon atoms, and a second olefin component which includes a 1-olefin recycle component containing 1-olefins of 8 to 10 carbon atoms, a plurality of cracked olefins containing from 3 to 5 carbon atoms and a plurality of dimers which comprise 16 to 20 carbon atoms;

b. separating the first polyalphaolefin component containing polyalphaolefins of at least 24 carbon atoms from the second olefin component, which includes a 1-olefin recycle component containing olefins of 8 to 10 carbon atoms, by distillation, the resulting first polyalphaolefin product having a viscosity index ranging from about 140 to 160 and a pour point ranging from about −65° F. to −30° F.;

c. directly subjecting the first polyalphaolefin product to hydrotreatment over a nickel containing catalyst under hydrotreating conditions of temperature and pressure to produce a synthetic lubricating oil base stock having a viscosity index ranging from about 140 to 160 and a pour point ranging from −25° to −20° F.;

d. separating the 1-olefin recycle component which contains 1-olefins of 8 to 10 carbon atoms from the second olefin component by distillation;

e. recycling said 1-olefin recycle component to the primary polymerization zone to produce more of the first polyalphaolefin component; and f. polymerizing the separated second olefin product of step d which includes the cracked olefins containing from 3 to 5 carbon atoms and a plurality of dimers which comprise 16 to 20 carbon atoms and which is substantially free of said 1-olefin recycle component in a secondary polymerization zone to produce a by-product lubricating oil.

2. The process of claim 1 in which the temperature of the primary polymerization zone ranges from 300° to 350° C.

3. The process of claim 1 in which the primary polymerization reaction is conducted for 3 to 20 hours.

4. The process of claim 1 in which the temperature of the hydrotreating step ranges from 150° to 300° C.

5. The process of claim 4 in which the pressure of the hydrotreating step ranges from 300 to 600 psig $H_2$.

6. A process for making a thermally stable lubricating oil comprising:

a. charging a plurality of 1-decenes to a primary polymerization zone under polymerization conditions sufficient to produce a first olefinic product having a viscosity index ranging from about 140 to 160 and a pour point ranging from about −65° to −30° F., the conditions comprising temperatures ranging from 280° C. to 400° C. and pressures less than about 280 psig sustained for 1 to 24 hours in a reactor which is free of catalytic material, the first olefinic product including a first polyalphaolefin component containing polyalphaolefins of at least 30 carbon atoms and a second olefin component which includes a 1-decene recycle component, a plurality of cracked olefins containing from 3 to 5 carbon atoms and a plurality of dimers which comprise 20 carbon atoms;

b. separating the first polyalphaolefin component containing polyalphaolefins of at least 30 carbon atoms from the second olefin component by distillation, the resulting separated first polyalphaolefin product having a viscosity index ranging from about 140 to 160 and a pour point ranging from about −65° F. to −30° F.;

c. directly subjecting the separated first polyalphaolefin product to mild hydrotreatment over a nickel containing catalyst under hydrotreating conditions of temperature and pressure to produce a first synthetic lubricating oil base stock having a viscosity index ranging from about 140 to 160 and a pour point ranging from −25° to −20° F.;

d. separating the 1-decene recycle component which contains 1-olefins of 8 to 10 carbon atoms from the second olefin component;

e. recycling said 1-decene recycle component to the primary polymerization zone; and f. polymerizing the separated cracked olefins containing from 3 to 5 carbon atoms and dimers which comprise 20 carbon atoms of the second component which are substantially free of the 1-decene recycle component in a secondary polymerization zone to produce a second polyalphaolefin product containing at least 30 carbon atoms.

7. The process of claim 6 in which the temperature of the primary polymerization zone ranges from 300° to 350° F.

8. The process of claim 6 in which the primary polymerization reaction is conducted for 3 to 20 hours.

9. The process of claim 6 in which the temperature of the hydrotreating step ranges from 150° to 300° C.

10. The process of claim 9 in which the pressure of the hydrotreating step ranges from 200 to 600 psig $H_2$.

11. The process of claim 6 in which the conditions of the secondary polymerization zone include temperatures ranging from 200° C. to 400° C. and pressures ranging from 100 psig to 1000 psig.

12. The process of claim 6 in which the nickel-containing hydrotreating catalyst is nickel on diatomaceous earth.

* * * * *